US006158874A

United States Patent [19]

Brustein et al.

[11] Patent Number: 6,158,874

[45] Date of Patent: Dec. 12, 2000

[54] MULTIPLE BEAM FLASHLIGHT

[76] Inventors: Samuel Brustein; Stacey S. Brustein, both of 1461 Bluff Ct., Suwanee, Ga. 30024

[21] Appl. No.: 09/314,344

[22] Filed: May 19, 1999

[51] Int. Cl.[7] ..... F21L 7/00

[52] U.S. Cl. ..... 362/184; 362/202; 362/205

[58] Field of Search ..... 362/184, 202, 362/205, 208, 395

[56] References Cited

U.S. PATENT DOCUMENTS

| | | | |
|---|---|---|---|
| 4,225,906 | 9/1980 | Gulliksen et al. . | |
| 4,274,130 | 6/1981 | Elliott . | |
| 4,782,432 | 11/1988 | Coffman . | |
| 5,077,644 | 12/1991 | Schaller et al. . | |
| 5,097,399 | 3/1992 | Gammache . | |
| 5,117,341 | 5/1992 | Huang . | |
| 5,217,297 | 6/1993 | Yuen . | |
| 5,467,258 | 11/1995 | Bamber et al. . | |
| 5,558,430 | 9/1996 | Booty, Jr. . | |
| 5,806,961 | 9/1998 | Dalton et al. | 362/183 |

*Primary Examiner*—Thomas M. Sember
*Attorney, Agent, or Firm*—Tipton L. Randall

[57] ABSTRACT

The invention is a multi-beam flashlight device with a high intensity lamp in a rotatable reflector housing at one end of the device, and a low intensity lamp positioned in the reflector housing to generate a low intensity light beam at an acute angle relative to the high intensity beam. Each lamp bulb is controlled individually by separate switches located on the case of the flashlight. A flat-sided ring member encircles the rotatable reflector housing to prevent the flashlight from rolling when placed on a surface. The low intensity lamp may be designed to produce a colored low intensity beam to reduce visual detection from a distance.

39 Claims, 11 Drawing Sheets

MULTIPLE BEAM FLASHLIGHT

FIELD OF THE INVENTION

The invention relates to a flashlight with two light beam sources, and more particularly, to a flashlight producing a high intensity light beam and a low intensity light beam.

BACKGROUND OF THE INVENTION

Flashlights are well known devices that provide a portable source of light for illuminating a chosen area. A variety of hand held flashlights are commercially available. These devices range from square shaped boxes having a carrying handle to palm sized units of widely varying shapes. The most common flashlights have a tubular handle that accommodates the dry cell batteries used to power the bulb, and a reflector housing at one end of the handle that holds the reflector and bulb, with a clear protective lens over the bulb and reflector. A simple switch on the tubular handle is used to activate and deactivate the bulb.

A recent development in flashlight technology is the introduction of a high intensity flash lamp bulb in place of the normal incandescent bulb. These high intensity lamp bulbs produce an intense light beam from a flashlight. The high intensity flashlights favored by law enforcement officers are commercially available from Maglight and Streamlight companies, and produce a light beam of 18,000-candle power. This powerful light beam is most useful in illuminating dark places during daylight as well as for nighttime use. The extreme brightness of the high intensity flashlight beam can sometimes be a liability for a law enforcement officer. When approaching a potentially dangerous situation during low light hours, the use of the high intensity flashlight beam can disclose the officer's position by lighting up the area around the user, as well as generating a bright dot of light showing the origin of the beam. Further, if the user illuminates the nearby ground and looks directly at the illuminated area, the user's night vision requires time to readjust after the light beam is shut off. Additionally, the user can temporarily blind other officers near the user, or silhouette nearby officers with the run off light that is generated by the high intensity flashlight. Although a second low intensity flashlight could be carried and used by law enforcement officers, such an extra piece of equipment is unnecessarily troublesome.

A number of patents concerned with flashlight devices have been granted. Gulliksen et al., in U.S. Pat. No. 4,225,906, disclose a lighting device with a rotatable bulb holder containing multiple bulbs. Each bulb can be positioned for use in a reflector by rotating the bulb holder. In U.S. Pat. No. 4,274,130, Elliot describes a flashlight containing a standard bulb and a high intensity bulb, both bulbs mounted in a single reflector, with separate switches for each. Coffman, in U.S. Pat. No. 4,782,432, discloses a rechargeable light having a front mounted spot light bulb with a fluorescent bulb and a strobe bulb, both contained within the transparent housing. In U.S. Pat. No. 5,077,644, Schaller et al. describe a flashlight with one bulb and reflector to produce a spot beam, and a second bulb and reflector to produce a rectangular flood beam. The spot beam is oriented at an angle relative to the flashlight axis. The flashlight is designed so that the spot beam faces in a forward direction and the flood beam in a downward direction. A single switch controls both bulbs.

In U.S. Pat. No. 5,097,399, Gammache discloses a swivel head flashlight. The head assembly includes a swivel head arranged for rotational movement about a swivel axis which is disposed at an acute angle relative to the axis of the casing. The swivel head carries a bulb and is asymmetrical so that rotational movement of the swivel head causes the beam of light emitted by the bulb to be directed in different directions. Huang, in U.S. Pat. No. 5,117,34, describes a cylindrical flashlight with a bulb and reflector at each end and a switch to selectively operate each bulb. U.S. Pat. No. 5,217,297 by Yuen discloses a combination lantern with an incandescent bulb and reflector at one end and a fluorescent bulb in a section that rotates through 180 degrees for positioning that bulb.

Bamber et al., in U.S. Pat. No. 5,467,258, describes a rechargeable flashlight with incandescent and fluorescent bulbs. A first switch activates the power source and a second switch selects which of the two light sources the power energizes. In U.S. Pat. No. 5,558,430, Booty, Jr. describes a dual beam flashlight with a primary fixed headlamp and a recessed rotatable secondary lamp energized only in the rotated position. Each lamp has its own energizing system to enable a user to energize either lamp separately or to have both lamps illuminated.

Thus, there is an unmet need for a single flashlight device that provides both a high intensity beam for normal use and a low intensity beam to prevent disclosing the location of the officer. Applicant has invented such a flashlight, and the novel flashlight is described below.

SUMMARY OF THE INVENTION

The invention is a multi-beam flashlight device including a generally cylindrical case member of selected diameter with first and second ends. A reflector housing member is fastened to the case member first end and has an open end opposite the case member. A first light beam generating unit, comprising a high intensity flash lamp member positioned within a reflector member, is mounted within the reflector housing member to generate a high intensity light beam from the reflector housing member open end opposite the case member. A second light beam generating unit, comprising at least a low intensity light source member, is positioned within the reflector housing member to generate a low intensity light beam at an acute angle relative to the high intensity light beam. An energizing source is contained within the cylindrical case member. A switch means is mounted on the case member for selectively energizing the high intensity flash lamp member from the energizing source, or for selectively energizing the low intensity bulb member from the energizing source.

DESCRIPTION OF THE PREFERRED EMBODIMENTS

| Nomenclature | |
|---|---|
| 10 | Multi-beam Flashlight Assembly |
| 20 | Cylindrical Case Member |
| 22 | First End of Case Member |
| 24 | Second End of Case Member |
| 26 | Removable End Cap Member |
| 30 | Reflector Housing Member |
| 32 | Conical Reflector Housing Section |
| 34 | Cylindrical Reflector Housing Section |
| 36 | Flat-sided Housing Encircling Member |
| 38 | Flat Surfaces of Encircling Member |
| 40 | Conical Reflector Housing Section |
| 42 | Open End of Reflector Housing Member |
| 44 | Reflector Member |
| 46 | High Intensity Flash Lamp Member |
| 48 | Transparent Lens Member |
| 50 | Threaded Lens Fastener Ring Member |
| 52 | Rectangular Aperture in Cylindrical Section Surface |
| 54 | Low Light Reflector Member |
| 56 | Low Intensity Light Source Member |
| 58 | Rectangular Lens Member |
| 60 | Battery Members |
| 62 | High Intensity Bulb Control Switch |
| 64 | Low Intensity Light Source Control Switch |
| 66 | Holder for High Intensity Bulb |
| 68 | Holder for Low Intensity Light Source |
| 70 | Low Light Beam Tubular Member |
| 72 | Low Intensity Light Source Member |
| 74 | Open End of Tubular Member |
| 76 | Adjustment Screw for Low Light Source Member |
| 78 | Slotted Head of Adjustment Screw |
| 80 | Mirror Assembly |
| 82 | Mirror Member |
| 84 | Reflective Surface of Mirror Member |
| 86 | Non-reflective Surface of Mirror Member |
| 88 | Linear L-Shaped Bracket Member |
| 90 | First Leg of Bracket Member |
| 92 | Second Leg of Bracket Member |
| 94 | Threaded End of Second Leg of Bracket |
| 96 | Threaded Aperture in Rotatable Reflector Housing |

Construction

Figure 1:
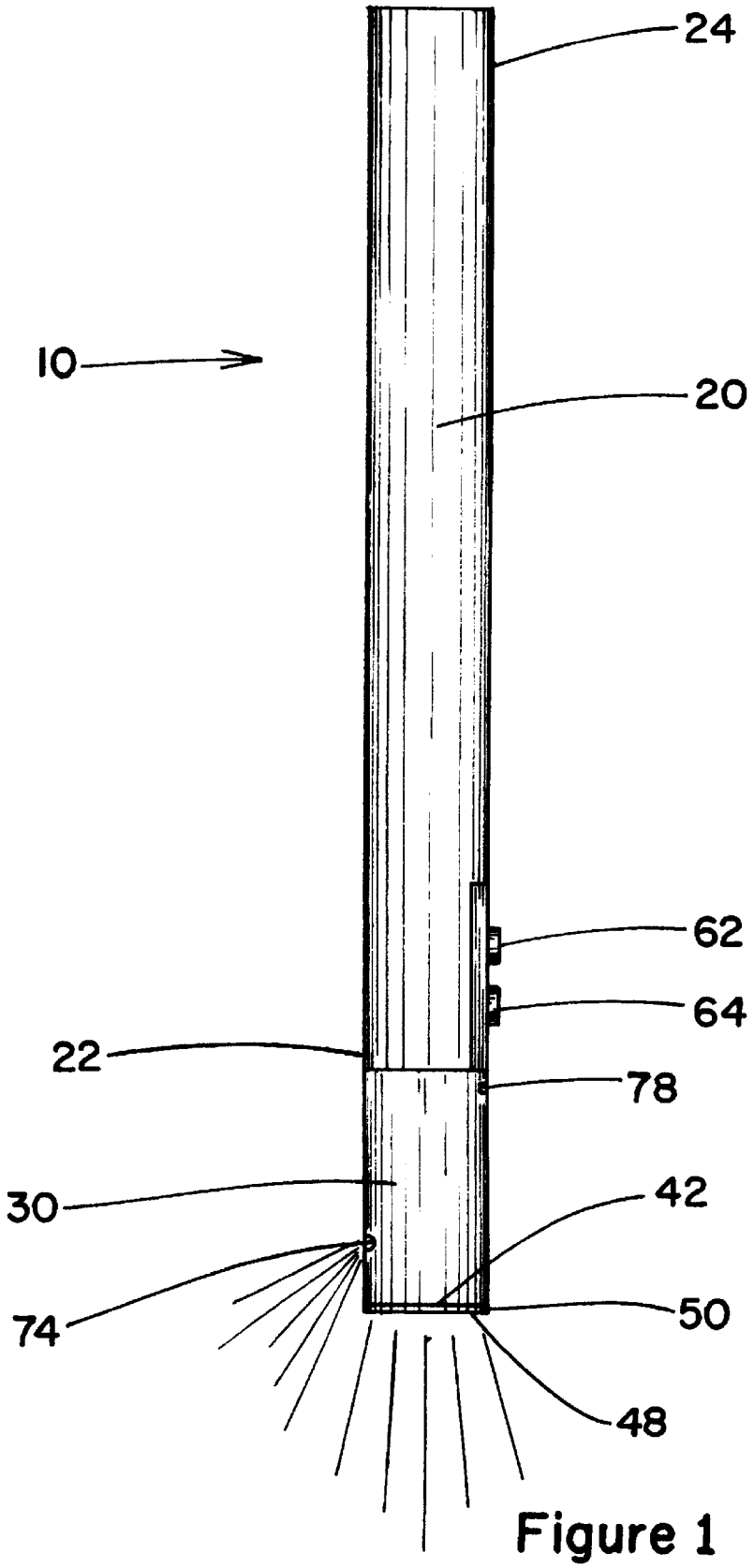
FIG. 1 is an elevational view of one embodiment of the flashlight device of the present invention.
Figure 2:
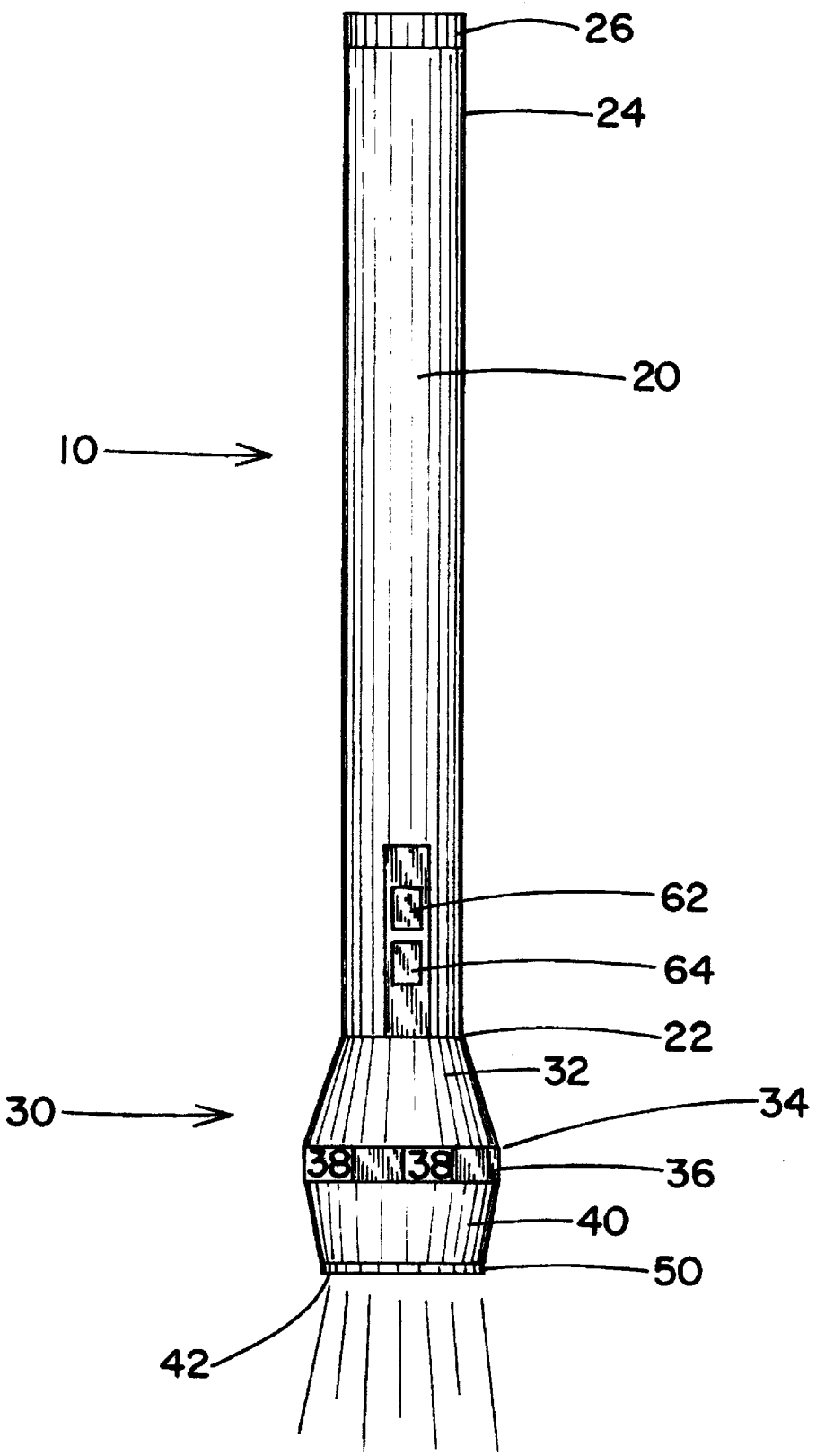
FIG. 2 is an elevational view of another embodiment of the flashlight device of the present invention.
Figure 3:
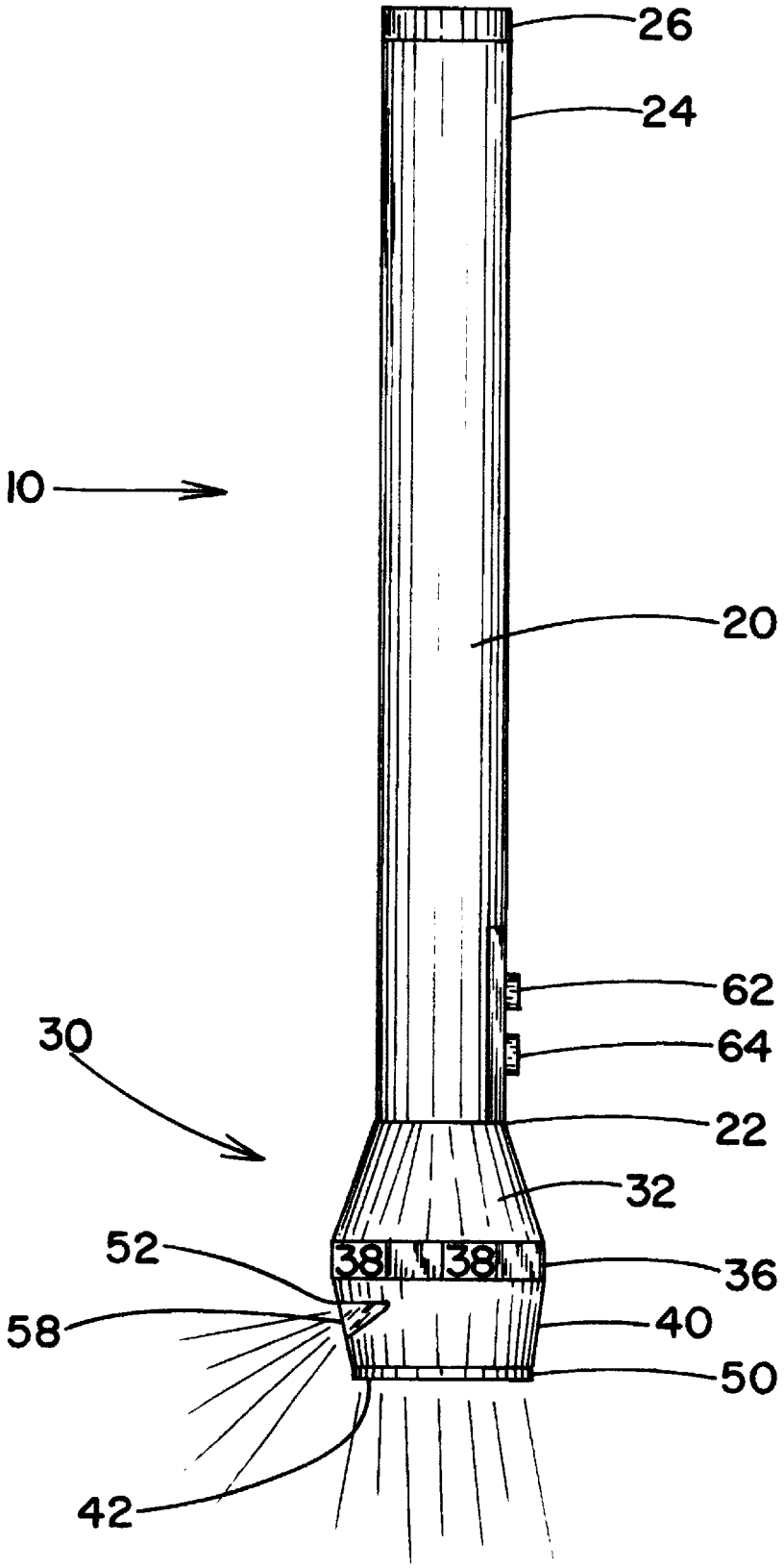
FIG. 3 is another elevational view of the embodiment of the flashlight device of FIG. 2 of the present invention.

Referring to FIG. 1, one embodiment of the present invention is shown. The multiple beam flashlight assembly 10 comprises a generally cylindrical case member 20 of a selected diameter, with a first end 22 and a second end 24. The case member 20 houses the batteries 60 that power the flashlight. The case member second end 24 is closed to retain the batteries 60 therein. Although the case member second end 24 may be permanently sealed, there is provided means for recharging or changing of the batteries 60 contained therein.

A Hollow reflector housing member 30 is attached to the first end 22 of the case member 20. Although the hollow reflector housing member 30 may be permanently attached to the first end 22 of the case member 20, it is preferred that the hollow reflector housing member 30 be rotatably attached thereto. Further, the reflector housing member 30 may be of any desired shape. The embodiment of FIG. 1 contains a cylindrical reflector housing member 30 of the same diameter as the case member 20.

The hollow reflector housing member 30 has an open end 42, opposite the case member first end 22, that allows placement of a reflector member 44 therein. The reflector member 44 contains a high intensity flash lamp 46 positioned at the focal point of the reflector 44. The reflector member 44 and flash lamp member 46 constitute a first light beam generating unit. The reflector member 44 and flash lamp 46 generate a high intensity light beam that is projected from the reflector housing open end 42 in a direction opposite the case member 20. A transparent lens member 48 covering the reflector member 44 and contained lamp member 46 is held in place by a threaded lens fastening member 50 that engages threads in the outer surface of the open end 42 of the reflector housing member 30. The lens member 48 protects the bulb member 46 and reflector member 44 from damage.

Figure 9:
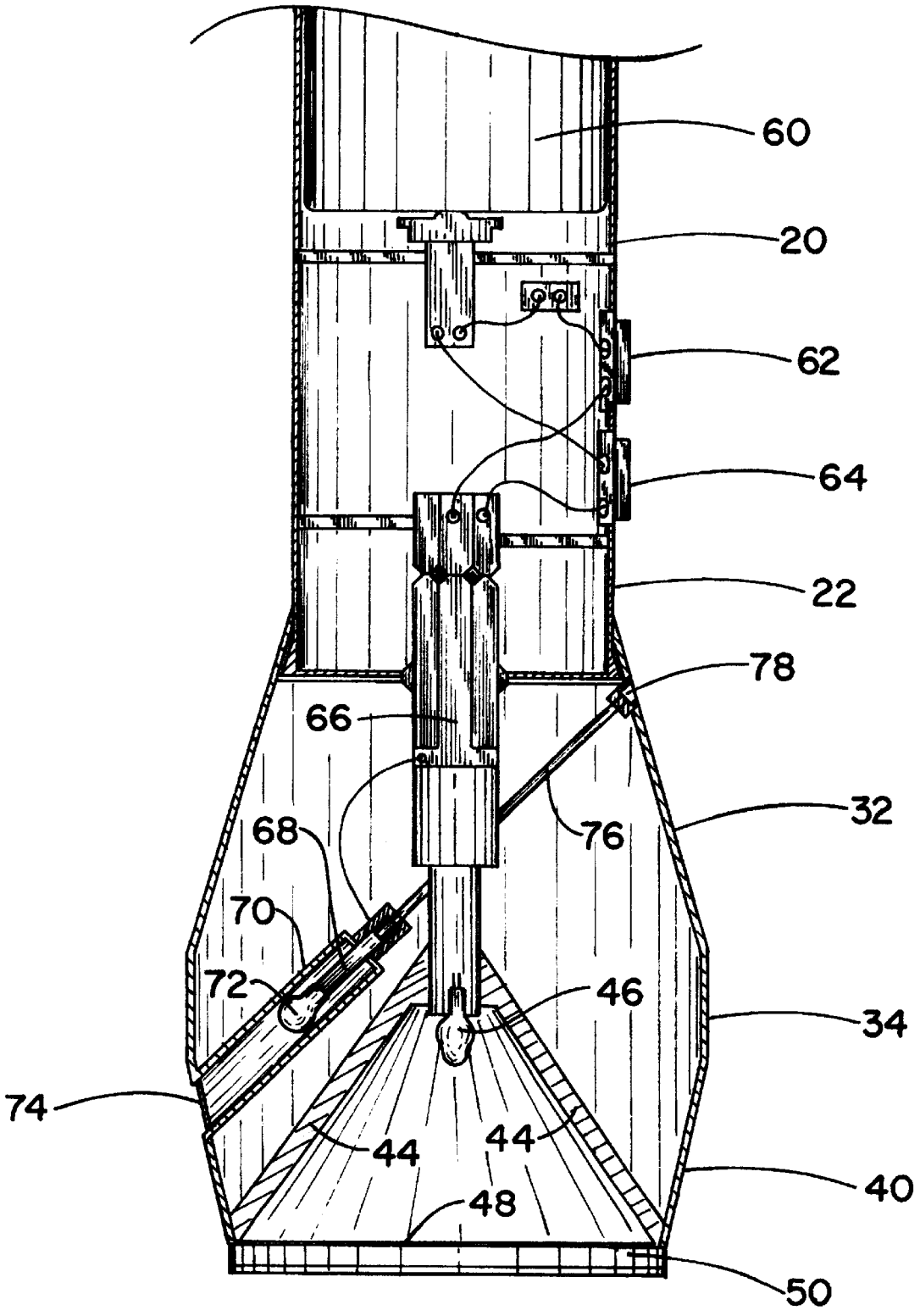
FIG. 9 is a cross sectional view of the rotatable reflector housing of the flashlight device of FIGS. 6–8.
Figure 10:
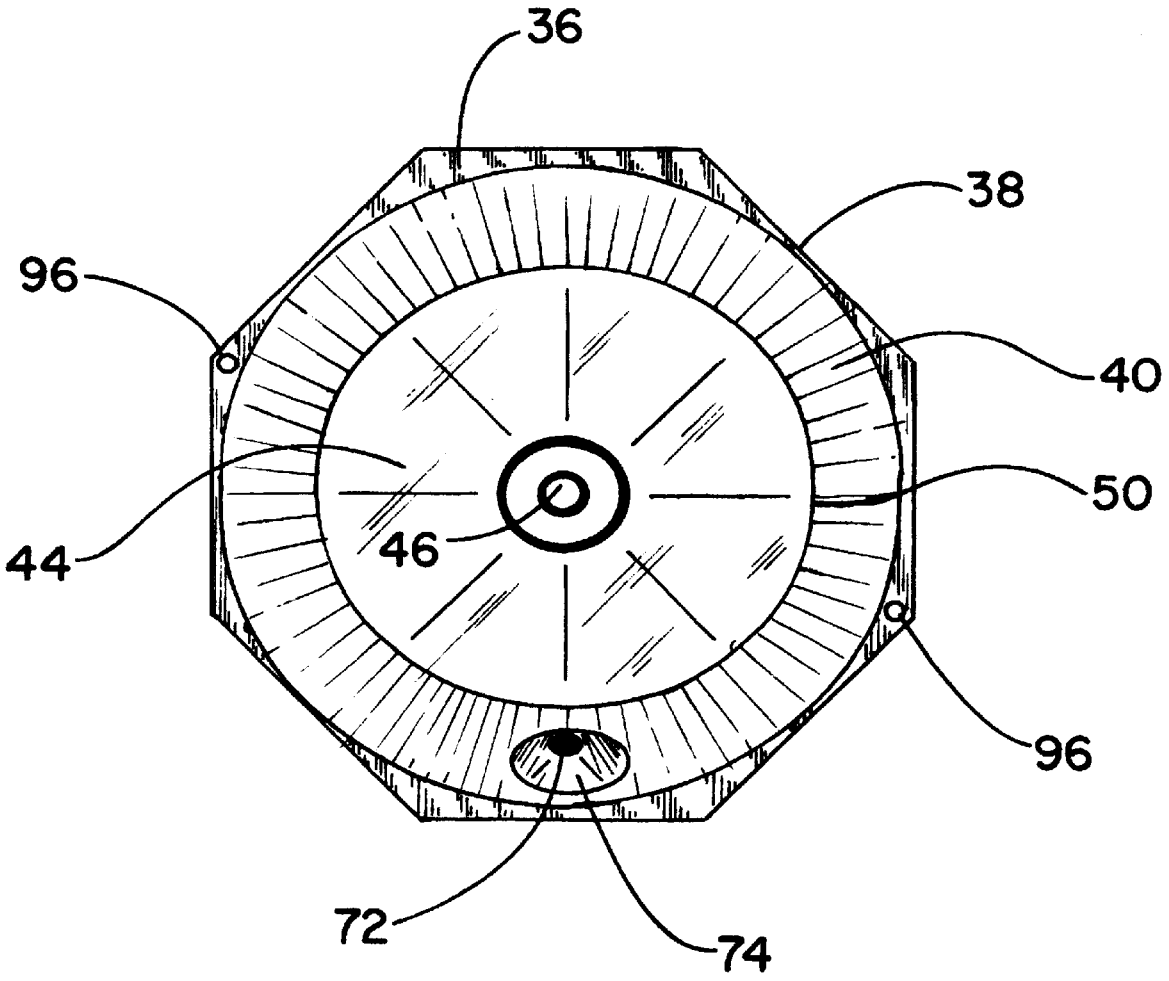
FIG. 10 is a front end view of the rotatable reflector housing of the flashlight device of FIGS. 6–8.

The reflector housing member 30 also contains a second light beam generating unit. In this embodiment, the surface of the reflector housing member 30 contains a generally tubular member 70 extending interior the reflector housing member 30. The generally tubular member 70 contains a low intensity light source member 72 that produces a low intensity light beam emanating from the generally tubular member 70 located within the reflector housing member 30. The low intensity light source 72 may be a simple incandescent bulb, a light emitting diode (LED) or even a fiber optic device. The generally tubular member 70 is positioned with an open end 74 at the surface of the reflector housing 30 to produces a low intensity light beam oriented at an acute angle relative to the high intensity beam produced from the front end of the flashlight member 10, as seen in FIG. 1. Details of the second low intensity light beam generating unit are shown in FIG. 9.

The low intensity light source member 72 is preferably non-white in color, and most preferably it is red in color. The position of the low intensity light source member 72 in the generally tubular member 70 can be stationary or adjustable. An adjustment screw member 76 is used to vary the location Of the low intensity light member 72 in the tube member 70. The screw member 76 is mounted within the tube member 70 with a slotted head 78 approximately flush with the surface of the reflector housing member 30.

Each light beam generating unit is powered by an energizing source contained within the cylindrical case member 20 in the form of batteries 60. The batteries 60 may be rechargeable for extended life. It may be desirable to provide a means for recharging the batteries 60 without removing the batteries 60 from the generally cylindrical case member 20. Such means is available on a number of commercial rechargeable electrical appliances. A switch means is mounted on the exterior surface of the flashlight device 10 to energize either the high intensity bulb 46 or the low intensity light source 56. Although a single toggle or slide switch can be used to selectively energize each light, it is preferred that separate and distinct switch members be present on the flashlight device 10.

It is an objective of the present invention to provide a low intensity light source member 72 that can be varied in its orientation to the switch means of the flashlight device 10. Although the low intensity light source member 72 can be stationary with the switch means moveable to provide selected orientation relative thereto, it is preferred that the switch means be stationary with the low intensity light source member 72 moveable through rotation of the reflector housing member 30.

The preferred pair of switch members are mounted on the exterior surface of the case member 20, with the first switch member 62 selectively energizing the high intensity flash lamp 46 and the second switch member 64 selectively energizing the low intensity light source member 54. The switch members 62, 64 are wired to the stationary high intensity bulb holder member 66, with the low intensity bulb holder member 68 electrically connected through the high intensity bulb holder member 66, as seen in FIG. 9.

Referring to FIGS. 2–5, another embodiment of the present invention is shown. The multiple beam flashlight assembly 10 comprises a generally cylindrical case member 20 of a selected diameter, with a first end 22 and a second end 24. The case member 20 houses the batteries 60 that power the flashlight. The case member second end 24 is closed to retain the batteries 60 therein. Although the case member second end 24 may be permanently sealed, it is preferred that a removable end cap member 26 be used to close the second end 24, allowing access to the batteries 60 contained therein.

Figure 4:
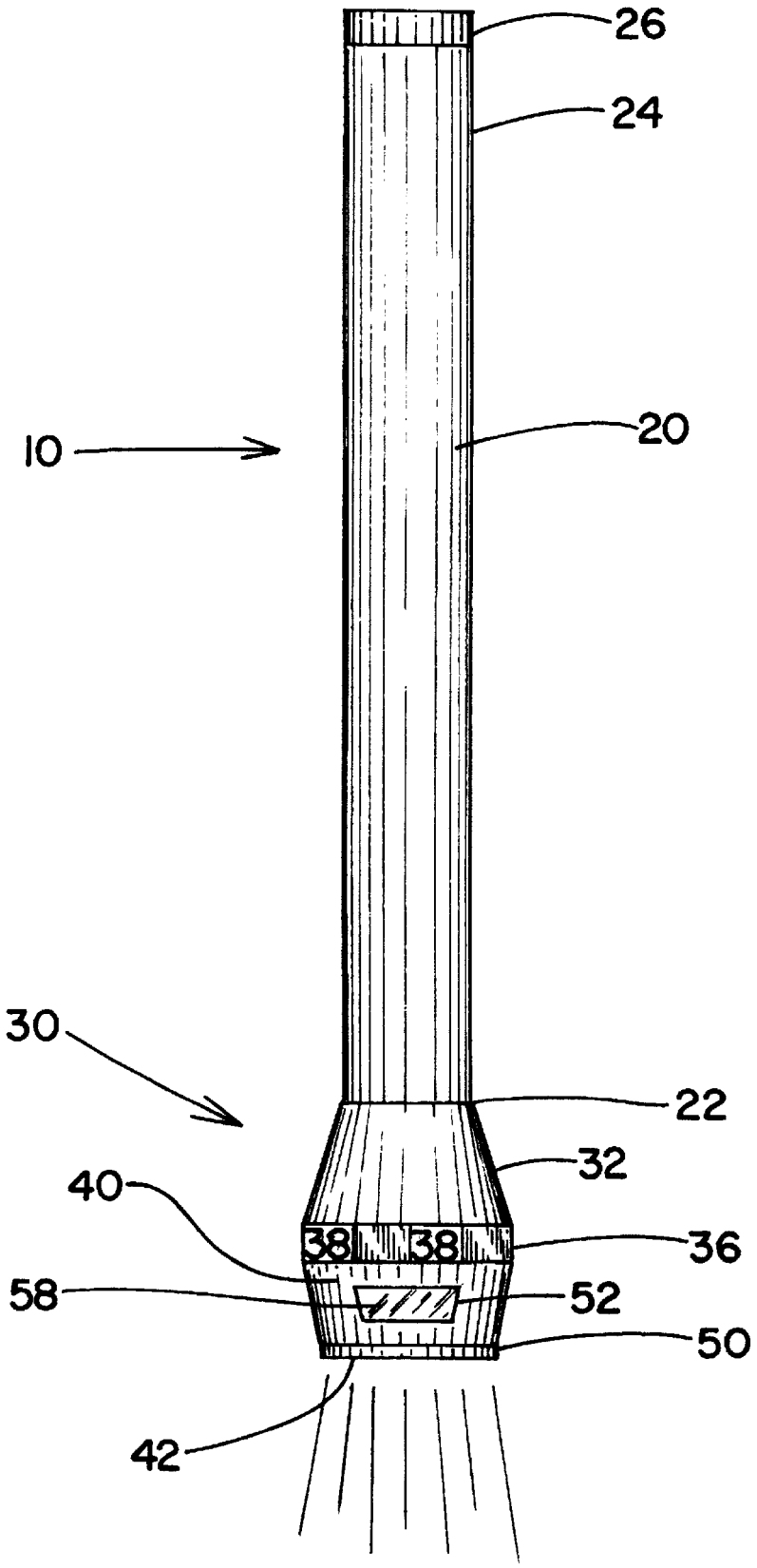
FIG. 4 is another elevational view of the embodiment of the flashlight device of FIG. 2 of the present invention.
Figure 5:
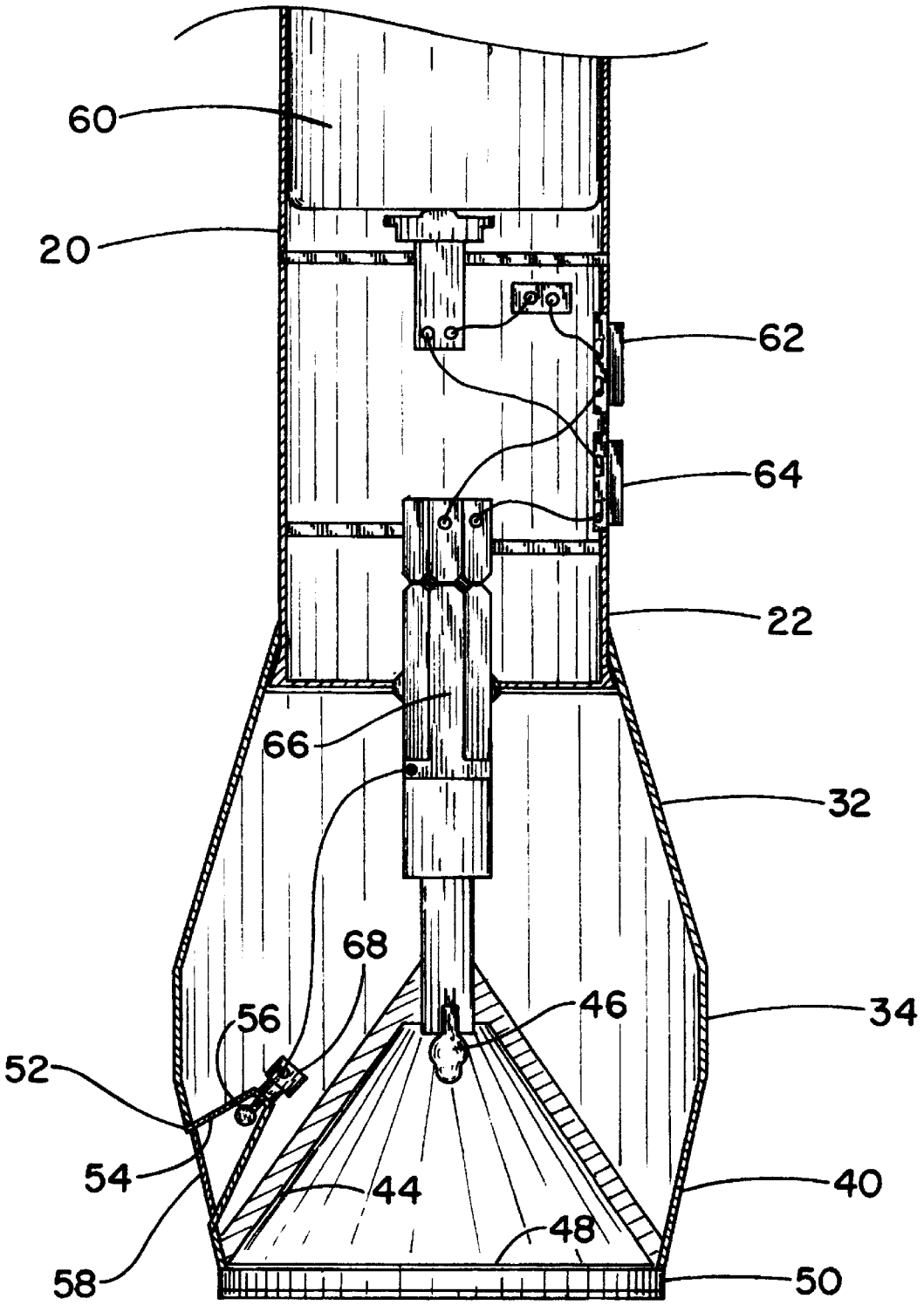
FIG. 5 is a cross sectional view of the rotatable reflector housing of the flashlight device of FIGS. 2–4.
Figure 6:
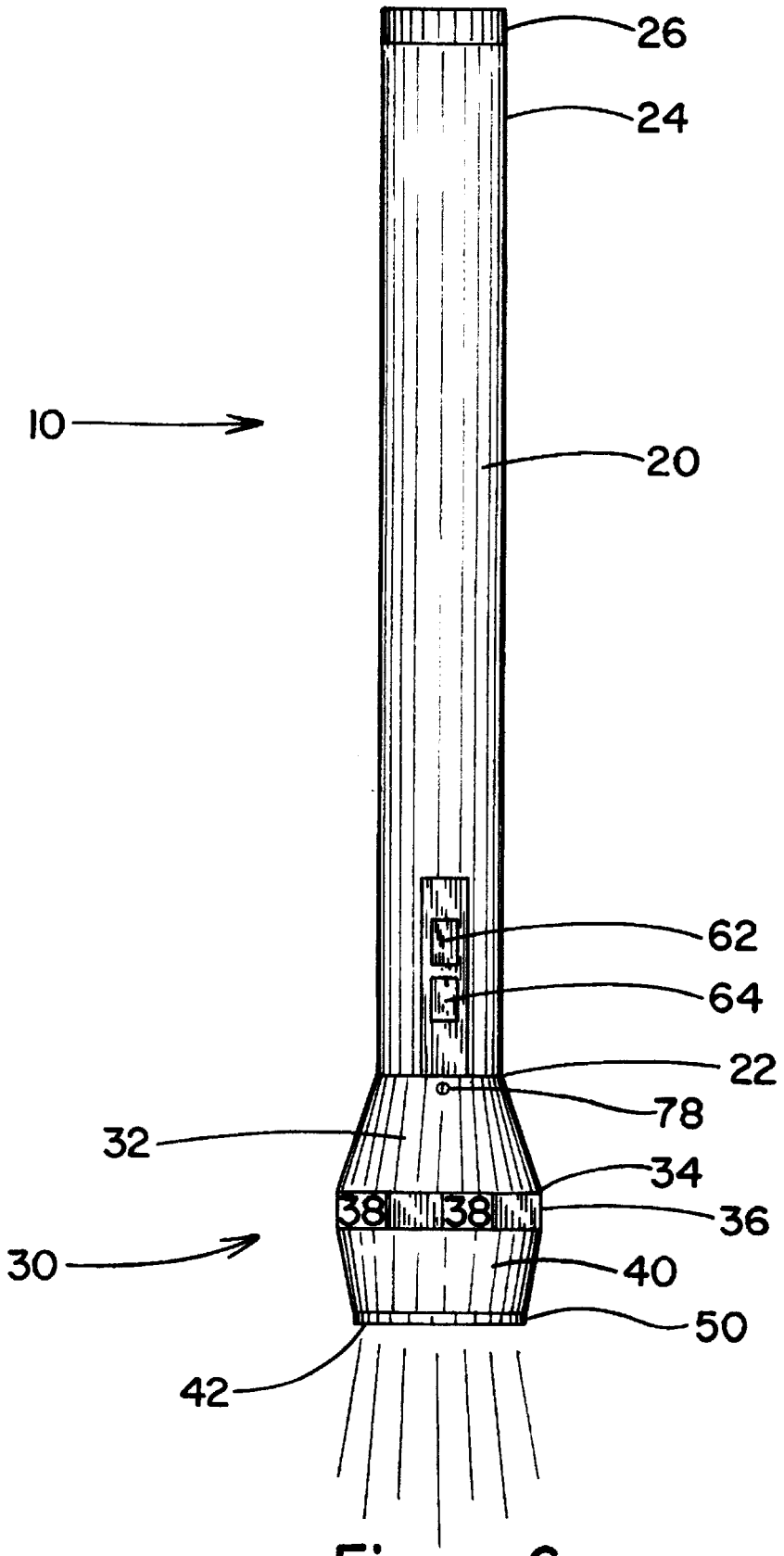
FIG. 6 is an elevational view of yet another embodiment of the flashlight device of the present invention.
Figure 7:
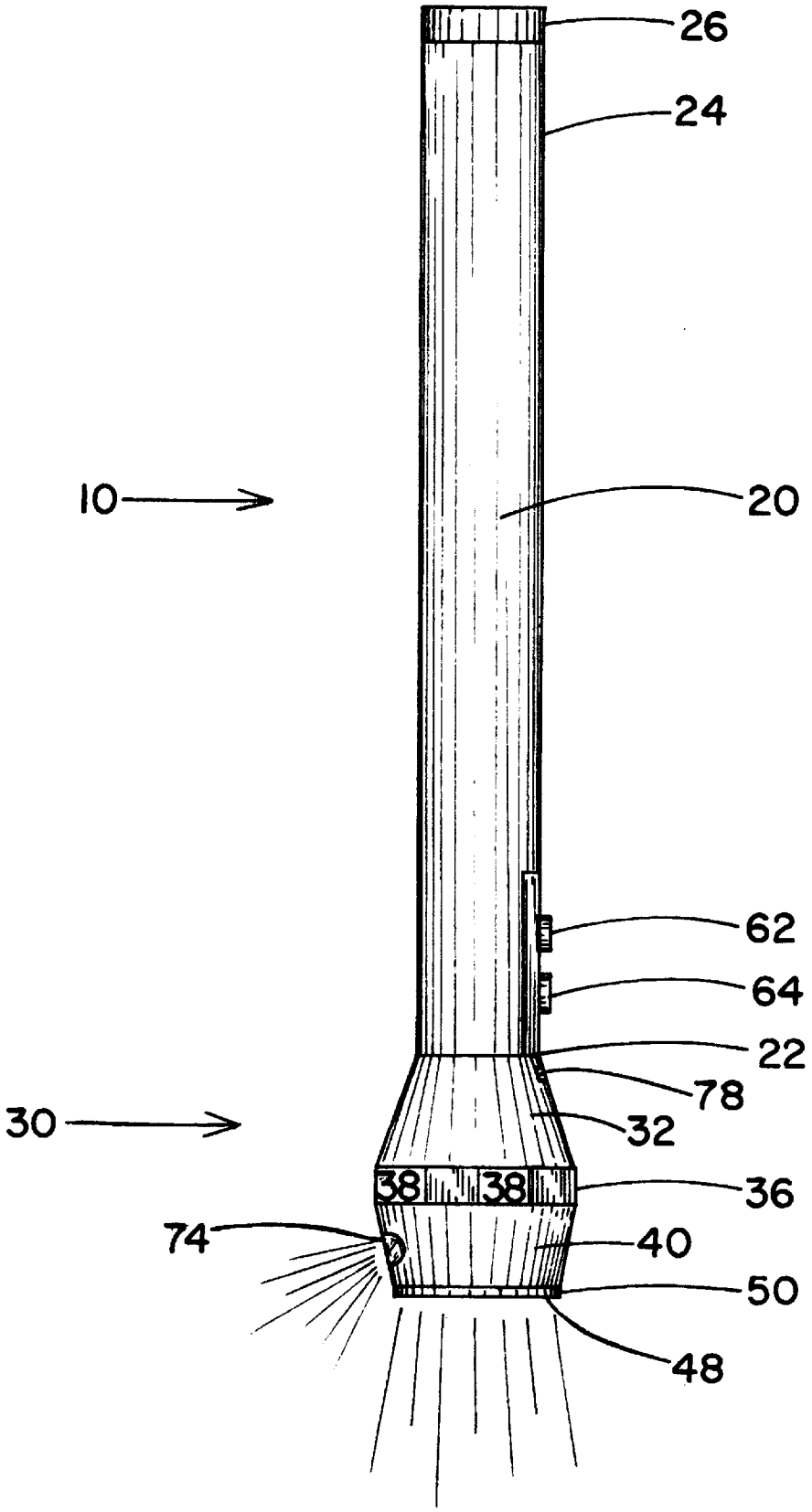
FIG. 7 is another elevational view of the embodiment of the flashlight device of FIG. 6 of the present invention.

A hollow reflector housing member 30 is attached to the first end 22 of the case member 20. Although the hollow reflector housing member 30 may be permanently attached to the first end 22 of the case member 20, it is preferred that the hollow reflector housing member 30 be rotatably attached thereto. Further, the reflector housing member 30 may be of any desired shape. However, it is preferred that he reflector housing member 30 is comprised of a first conical section 32 that is adjacent and rotatably attached to the case member first end 22. The first conical section 32 increases in diameter with increasing distance from the case member 20. A cylindrical housing section 34 of diameter greater than the case member 20 comprises the middle of the reflector housing member 30. A flat-sided housing encircling member 36 is secured around the cylindrical section 34 of the reflector housing, providing a plurality of flat surfaces 38 for the reflector housing member 30. The flat surfaces 38 prevent the flashlight assembly 10 from rolling when placed on a surface. A second conical section 40 attached to the cylindrical housing section 34 completes the preferred reflector housing member 30. The second conical section 40 decreases in diameter with increasing distance from the case member 20. The hollow reflector housing member 30 has an open end 42, opposite the case member first end 22, that allows placement of a reflector member 44 therein. The reflector member 44 contains a high intensity flash lamp 46 positioned at the focal point of the reflector 44, as seen in FIG. 4. The reflector member 44 and flash lamp member 46 constitute a first light beam generating unit. The reflector member 44 and flash lamp 46 generate a high intensity light beam that is projected from the reflector housing open end 42 in a direction opposite the case member 20. A transparent lens member 48 covering the reflector member 44 and contained lamp member 46 is held in place by a threaded lens fastening member 50 that engages threads in the outer surface of the open end 42 of the reflector housing member 30. The lens member 48 protects the bulb member 46 and reflector member 44 from damage.

The preferred rotatable reflector housing member 30 also contains a second light beam generating unit. In this embodiment, the surface of the second conical section 40 contains a generally rectangular aperture 52 in which is positioned a low intensity light beam generating unit. This unit comprises a generally rectangular reflector member 54 with a low intensity bulb 56 therein. The rectangular reflector member 54 is covered by a rectangular lens member 58 that is secured within the rectangular aperture 52 in the reflector housing member 30. The lens member 58 is non-white in color and is preferably red in color. Alternatively, the lens member 58 is clear and the low intensity bulb member 56 is non-white in color, and the bulb is preferably red in color. If desired, both the lens member 58 and the low intensity bulb member 56 are preferably non-white, and most preferably both members are red in color.

Each light beam generating unit is powered by an energizing source contained within the cylindrical case member 20 in the form of batteries 60. The batteries 60 may be rechargeable for extended life. It may be desirable to provide a means for recharging the batteries 60 without removing the batteries 60 from the generally cylindrical case member 20. Such means is available on a number of commercial rechargeable electrical appliances. A switch means is mounted on the exterior surface of the case member 20 to energize either the high intensity bulb 46 or the low intensity bulb 56. Although a single toggle or slide switch can be used to selectively energize each bulb, it is preferred that separate and distinct switch members be present on the cylindrical surface member 20.

The preferred pair of switch members are mounted on the exterior surface of the case member 20, with the first switch member 62 selectively energizing the high intensity flash lamp 46 and the second switch member 64 selectively energizing the low intensity bulb member 54. The switch members 62, 64 are wired to the stationary high intensity bulb holder member 66, with the low intensity bulb holder member 68 electrically connected through the high intensity bulb holder member 66.

Figure 8:
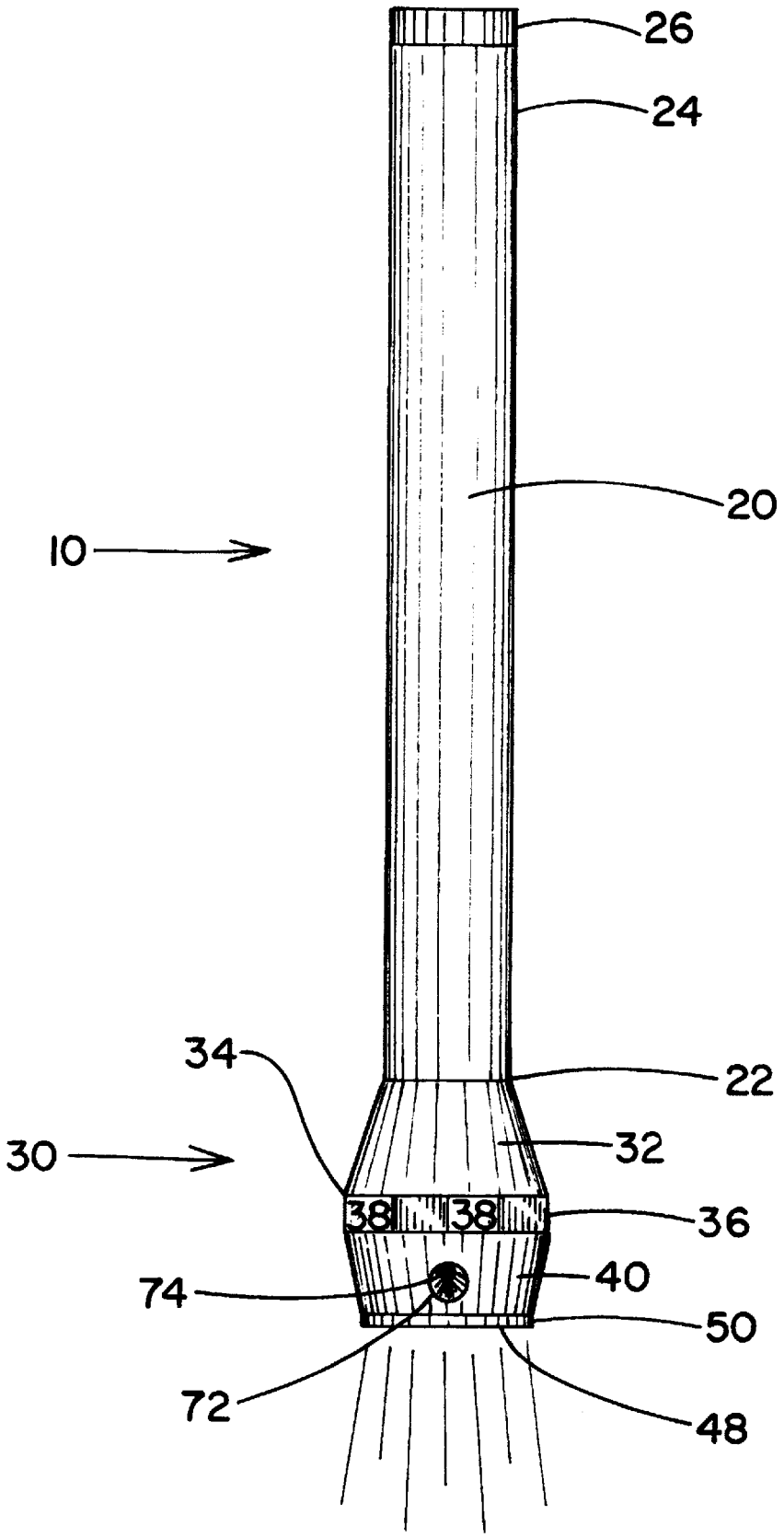
FIG. 8 is another elevational view of the embodiment of the flashlight device of FIG. 6 of the present invention.

An alternative embodiment of the multiple beam flashlight member 10 is shown in FIGS. 6–10. Those components in common with the embodiment of FIGS. 1–5 are designated with the same indica. The alternative embodiment of the invention includes a modification of the low intensity second light beam generating unit. The second light beam generating unit of this embodiment comprises a generally tubular member 70 extending interior the hollow rotatable reflector housing member 30. The generally tubular member 70 contains a low intensity light source member 72 that produces a low intensity light beam emanating from the generally tubular member 70 located within the reflector housing member 30. The low intensity light source 72 may be a simple incandescent bulb, a light emitting diode (LED) or even a fiber optic device. The generally tubular member 70 is positioned with an open end 74 at the surface of the second conical section 40 of the reflector housing 30 with the generally tubular member 70 oriented toward the first conical section 32, as seen in FIG. 8. This position of the generally tubular member 70 produces a low intensity light beam oriented at an acute angle relative to the high intensity beam produced from the front end of the flashlight member 10, as seen in FIG. 9.

The low intensity light source member 72 is preferably non-white in color, and most preferably it is red in color. The position of the low intensity light source member 72 can be permanent, or the position of the low intensity light source member 72 in the generally tubular member 70 can be adjustable. An adjustment screw member 76 is used to vary the location of the low intensity light member 72 in the tube member 70. The screw member 76 is mounted within the tube member 70 with a slotted head 78 approximately flush with the surface of the first conical section 32 of the rotatable reflector member 30. Again, the low intensity light source member 72 is selectively energized by the second switch member 64 positioned on the surface of the case member 20. Likewise, the switch members 62, 64 are wired to the stationary high intensity bulb holder member 66, with the low intensity light source holder member 68 electrically connected through the high intensity bulb holder member 66.

The features provided by the multiple beam flashlight device 10 of the present invention are numerous. The orientation of the low intensity light beam at an acute angle relative to the high intensity beam directs the low intensity beam away from the individual carrying the flashlight 10 in his/her hand. This orientation prevents illumination of the individual or near by persons to a distant observer. The low intensity light beam orientation also prevents a distant observer from detecting the origin of that low intensity light beam. The low beam orientation also illuminates the forward path of the individual, but does not force the user's eyes to readjust from bright light to near total darkness where the high intensity beam is used for illuminating the user's path. Additionally, the preferred red color of the low intensity light beam further reduces detection by a distant observer.

The direction and, in one embodiment, the size of the low intensity beam are adjustable by the user. The rotatable reflector housing 30 allows the low intensity light beam direction to be adjusted relative to the switch buttons 62, 64 on the case member 20. Thus, an individual can use either the push-carry grip, with the light held below shoulder level, or the stabbing holding position, with the light held above shoulder level, and adjust the low intensity light beam as desired. The rotatable reflector housing 30 enables the user to employ either the thumb or the fingers of the hand carrying the flashlight member 10 to operate the two switch member 62, 64. Rotation of the rotatable reflector housing member 60 does not alter the position of the high intensity lamp member 46 in the reflector member 44. Thus, reflector housing rotation does not change the focus of the high intensity light beam.

Further, in the embodiment of the invention of FIGS. 1 and 5–9, the size of the low intensity light beam is adjustable by varying the position of the low intensity light source member 72 within the generally tubular member 70 by means of the adjustment screw 78. Moving the position of the light source member 72 further into the generally tubular member 70 narrows the low intensity beam emanating from the generally tubular opening 74.

The separate control switches 62, 64 provide complete control of which light beam is activated. The tactile difference between the individual switch members allows easy discrimination between the two by the user in the dark or when the user is wearing gloves. The flat surface 38 of the reflector housing encircling member 36 prevents the flashlight device 10 from rolling when placed on a relatively flat surface.

Figure 11:
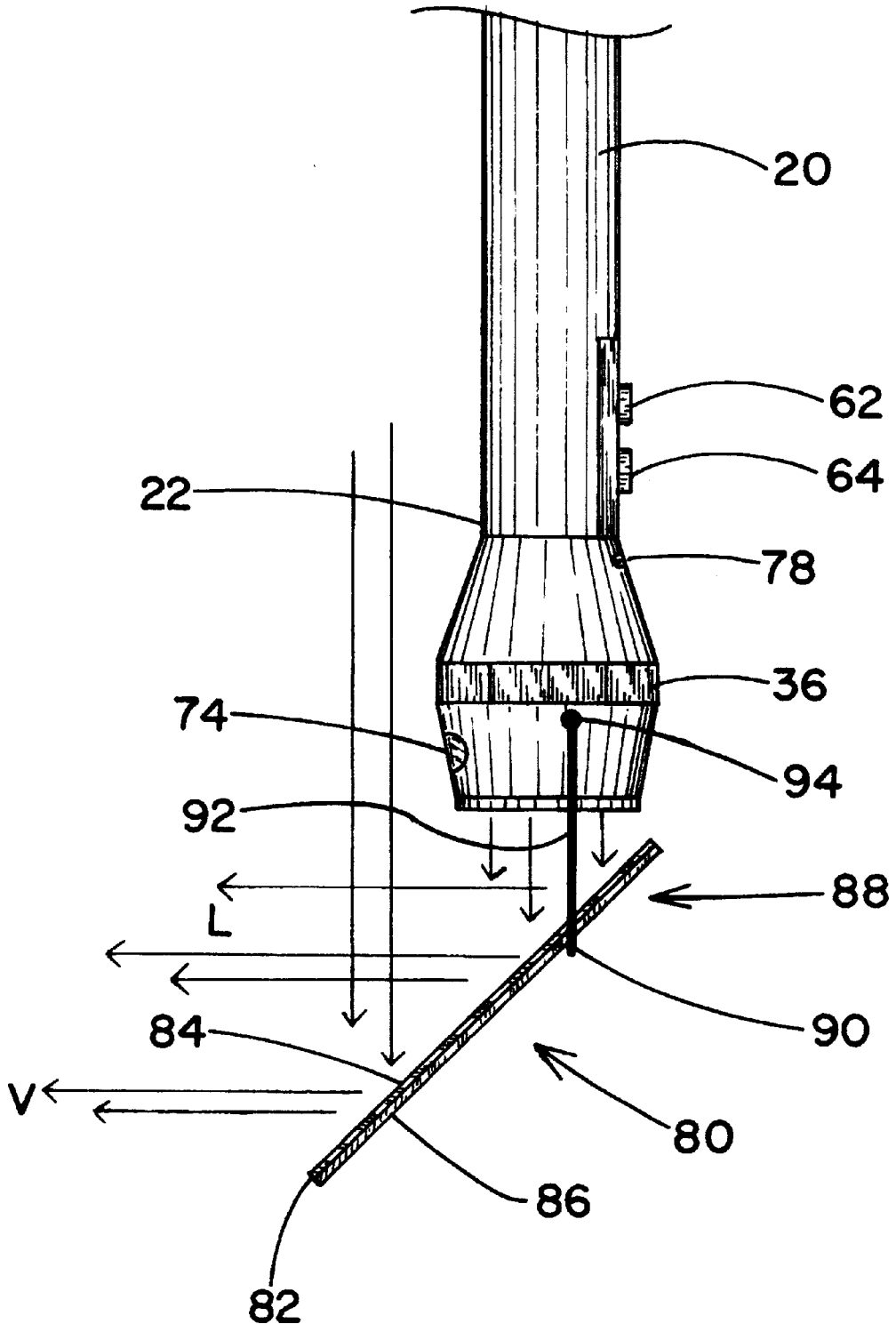
FIG. 11 is an elevational side view of the flashlight device fitted with the reflecting mirror assembly.

In a further embodiment of the invention, shown in FIG. 11, a detachable mirror assembly 80 is fastened to the flat-sided, rotatable reflector encircling housing 36 of the flashlight member 10. The mirror assembly 80 is used to reflect the high intensity light beam at a right angle relative to the case member 20. The detachable mirror assembly 80 comprises a planar mirror member 82 having a reflective surface 84 and a non-reflective surface 86. An L-shaped cylindrical bracket member 88 is fastened to the mirror member non-reflective surface 86 by a first leg 90 of the bracket. The second leg 92 of the bracket member 88 extends from adjacent the mirror member edge and beyond the mirror member reflective surface 84 at a non-perpendicular angle relative thereto. The bracket member 88 is preferably a rigid wire member with the end 94 of the second leg 92 having threads. The second leg threaded end 94 is secured within a threaded aperture 96 in the rotatable reflector housing 30. The bracket member 88 positions the mirror member 82 in the high intensity light beam emanating from the end of the reflector housing member 30, thereby reflecting the high intensity light beam at a right angle relative to the original direction of that high intensity beam. The mirror assembly 80 allows the user to direct a high intensity beam into a dark area, such as an attic or crawl space, without exposing the user to that darkened area. Such a capability is highly important to a law enforcement officer in high risk situations. Additionally, the attachment of the mirror assembly 80 to the flashlight member 10 allows the user to illuminate a darkened area with one hand, leaving the other hand free to hold a weapon at the ready.

While the invention has been particularly shown and described with reference to a preferred embodiment thereof, it will be understood by those skilled in the art that various changes in form and details may be made therein without departing from the spirit and scope of the invention.

We claim:

1. A multi-beam flashlight device comprising:

(a) a generally cylindrical case member of selected diameter with first and second ends;

(b) a reflector housing member fastened to said case member first end, said reflector housing member having an open end opposite said case member;

(c) a first light beam generating unit comprising a high intensity flash lamp member positioned within a reflector member, said first light beam generating unit positioned within said reflector housing member to generate a high intensity light beam from said reflector housing member open end opposite said case member;

(d) a second light beam generating unit comprising at least a low intensity light source member positioned within said reflector housing member to generate a low intensity light beam at an acute angle to said high intensity light beam;

(e) a transparent lens member covering said open end of said reflector member with high intensity lamp member therein, said lens member held in position by a lens fastening means secured to said reflector housing member;

(f) an energizing source contained within said cylindrical case member; and (g) switch means mounted on said flashlight device for selectively energizing said high intensity flash lamp member from said energizing source, or for selectively energizing said low intensity light source member from said energizing source.

2. The multi-beam flashlight device according to claim 1, wherein said switch means is moveable relative to said second light beam generating unit.

3. The multi-beam flashlight device according to claim 1, wherein said reflector housing member is rotatably fastened to said case member first end.

4. The multi-beam flashlight device according to claim 1, further comprising a flat-sided reflector housing encircling member secured around said reflector housing member.

5. The multi-beam flashlight device according to claim 1, wherein said second light beam generating unit is a low intensity light source member mounted in a reflector member positioned behind a lens member secured in an aperture in said reflector housing surface.

6. The multi-beam flashlight device according to claim 5, wherein said lens member is a non-white color.

7. The multi-beam flashlight device according to claim 5, wherein said low intensity light member is a non-white color.

8. The multi-beam flashlight device according to claim 5, wherein said lens member and said low intensity light source member are both a non-white color.

9. The multi-beam flashlight device according to claim 1, wherein said second light beam generating unit is a low intensity light source member mounted in a generally tubular member extending interior said reflector housing member.

10. The multi-beam flashlight device according to claim 9, wherein said low intensity light source member is movably positioned within said generally tubular member.

11. The multi-beam flashlight device according to claim 10, further comprising threaded adjusting means in said generally tubular member for adjusting said low intensity light source position.

12. The multi-beam flashlight device according to claim 9, wherein said low intensity light source member is a non-white color.

13. The multi-beam flashlight device according to claim 1, wherein said switch means comprises first and second switch members each mounted on said case member, said first switch member for selectively energizing said high intensity flash lamp member from said energizing source, and said second switch member for selectively energizing said low intensity light source member from said energizing source.

14. The multi-beam flashlight device according to claim 1, wherein said reflector housing member comprising a first conical housing section adjacent and fastened to said case member first end, a cylindrical housing section integral with said first conical housing section, said reflector cylindrical housing member section of diameter greater than said case member diameter, and a second conical housing section opposite said cylindrical case member and integral with said cylindrical housing section, said second conical housing section having an open end opposite said case member.

15. The multi-beam flashlight device according to claim 4, further comprising a mirror assembly reversibly attached to said flat-sided reflector housing encircling member, said mirror assembly comprising;

(i) a planar mirror member having a reflective surface and a non-reflective surface;

(ii) an L-shaped cylindrical bracket member having first and second leg members, said first leg member fastened to said mirror member non-reflective surface, said second leg member extending beyond the mirror reflective surface at a non-perpendicular angle thereto; and (iii) a threaded aperture in said flat-sided reflector housing encircling member adapted for accepting said second leg member threaded end, whereby fastening said mirror assembly to said flat-sided reflector housing encircling member positions said mirror member in the high intensity light beam, thereby reflecting said beam at an angle relative to the beam's original direction.

16. A multi-beam flashlight device comprising:

(a) a generally cylindrical case member of selected diameter with first and second ends;

(b) a removable end cap member fastened to said case member second end;

(c) a reflector housing member fastened to said case member first end, said reflector housing member comprising a first conical housing section adjacent and fastened to said case member first end, a cylindrical housing section integral with said first conical housing section, said reflector cylindrical housing member section of diameter greater than said case member diameter, and a second conical housing section opposite said cylindrical case member and integral with said cylindrical housing section, said second conical housing section having an open end opposite said case member, (d) a first light beam generating unit comprising a high intensity flash lamp member positioned within a reflector member, said first light beam generating unit positioned within said reflector housing member to generate a high intensity light beam from said second conical housing section open end opposite said case member;

(e) a second light beam generating unit comprising at least a low intensity light source member positioned within said reflector housing member to generate a low intensity light beam at an acute angle to said high intensity light beam;

(f) a transparent lens member covering said open end of said conical section of said reflector member with high intensity lamp member therein, said lens member held in position by a lens fastening means secured to said reflector housing member;

(g) an energizing source contained within said cylindrical case member; and (h) switch means mounted on said flashlight device for selectively energizing said high intensity flash lamp member from said energizing source, or for selectively energizing said low intensity light source member from said energizing source.

17. The multi-beam flashlight device according to claim 16, wherein said switch means is moveable relative to said second light beam generating unit.

18. The multi-beam flashlight device according to claim 16, wherein said reflector housing member is rotatably fastened to said case member first end.

19. The multi-beam flashlight device according to claim 16, further comprising a flat-sided reflector housing encircling member secured around said reflector housing member.

20. The multi-beam flashlight device according to claim 16, wherein said second light beam generating unit is a low intensity light source member mounted in a reflector member positioned behind a lens member secured in an aperture in said reflector housing second conical section surface.

21. The multi-beam flashlight device according to claim 20, wherein said lens member is a non-white color.

22. The multi-beam flashlight device according to claim 20, wherein said low intensity light source member is a non-white color.

23. The multi-beam flashlight device according to claim 20, wherein said lens member and said low intensity light source member are both a non-white color.

24. The multi-beam flashlight device according to claim 16, wherein said second light beam generating unit is a low intensity light source member mounted in a generally tubular member extending interior said reflector housing member.

25. The multi-beam flashlight device according to claim 24, wherein said generally tubular member extends interior from said reflector housing second conical section surface.

26. The multi-beam flashlight device according to claim 24, wherein said low intensity light source member is movably positioned within said generally tubular member.

27. The multi-beam flashlight device according to claim 26, further comprising threaded adjusting means in said generally tubular member for adjusting said low intensity light source position.

28. The multi-beam flashlight device according to claim 24, wherein said low intensity light source member is a non-white color.

29. The multi-beam flashlight device according to claim 16, wherein said switch means comprises first and second switch members each mounted on said case member, said first switch member for selectively energizing said high intensity flash lamp member from said energizing source, and said second switch member for selectively energizing said low intensity light source member from said energizing source.

30. A multi-beam flashlight device comprising:

(a) a generally cylindrical case member of selected diameter with first and second ends, (b) a removable end cap member fastened to said case member second end;

(c) a reflector housing member rotatably fastened to said case member first end, said reflector housing member comprising a first conical housing section adjacent and rotatably fastened to said case member first end, a cylindrical housing section integral with said first conical housing section, said reflector cylindrical housing member section of diameter greater than said case member diameter, and a second conical housing section opposite said cylindrical case member and integral with said cylindrical housing section, said second conical housing section having an open end opposite said case member, (d) a first light beam generating unit comprising a high intensity flash lamp member positioned within a reflector member, said first light beam generating unit positioned within said rotatable housing member to generate a high intensity light beam from said second conical housing section open end opposite said case member;

(e) a flat-sided reflector housing encircling member secured around said reflector housing member;

(f) a transparent lens member covering said open end of said conical section of said reflector member with high intensity lamp member therein, said lens member held in position by a lens fastening means secured to said reflector housing member;

(g) a second light beam generating unit comprising a low intensity bulb member mounted in a reflector member positioned behind a lens member secured in an aperture in said rotatable reflector housing second conical section surface to generate a low intensity light beam at an acute angle to said high intensity light beam;

(h) an energizing source contained within said cylindrical case member; and (i) switch means mounted on said flashlight device for selectively energizing said high intensity flash lamp member from said energizing source, or for selectively energizing said low intensity bulb member from said energizing source.

31. The multi-beam flashlight device according to claim 30, wherein said lens member is a non-white color.

32. The multi-beam flashlight device according to claim 30, wherein said low intensity bulb member is a non-white color.

33. The multi-beam flashlight device according to claim 30, wherein said lens member and said low intensity bulb member are both a non-white color.

34. The multi-beam flashlight device according to claim 30, wherein said switch means comprises first and second switch members each mounted on said case member, said first switch member for selectively energizing said high intensity flash lamp member from said energizing source, and said second switch member for selectively energizing said low intensity bulb member from said energizing source.

35. The multi-beam flashlight device according to claim 30, further comprising a mirror assembly reversibly attached to said flat-sided reflector housing encircling member, said mirror assembly comprising;

(i) a planar mirror member having a reflective surface and a non-reflective surface;

(ii) an L-shaped cylindrical bracket member having first and second leg members, said first leg member fastened to said mirror member non-reflective surface, said second leg member extending beyond the mirror reflective surface at a non-perpendicular angle thereto; and (iii) a threaded aperture in said flat-sided reflector housing encircling member adapted for accepting said second leg member threaded end, whereby fastening said mirror assembly to said flat-sided reflector housing encircling member positions said mirror member in the high intensity light beam, thereby reflecting said beam at an angle relative to the beam's original direction.

36. A multi-beam flashlight device comprising:

(a) a generally cylindrical case member of selected diameter with first and second ends;

(b) a removable end cap member fastened to said case member second end;

(c) a reflector housing member rotatably fastened to said case member first end, said reflector housing member comprising a first conical housing section adjacent and rotatably fastened to said case member first end, a cylindrical housing section integral with said first conical housing section, said reflector cylindrical housing member section of diameter greater than said case member diameter, and a second conical housing section opposite said cylindrical case member and integral with said cylindrical housing section, said second conical housing section having an open end opposite said case member;

(d) a first light beam generating unit comprising a high intensity flash lamp member positioned within a reflector member, said first light beam generating unit positioned within said rotatable housing member to generate a high intensity light beam from said second conical housing section open end opposite said case member;

(e) a flat-sided reflector housing encircling member secured around said reflector housing member;

(f) a transparent lens member covering said open end of said conical section of said reflector member with high intensity lamp member therein, said lens member held in position by a lens fastening means secured to said reflector housing member;

(g) a second light beam generating unit comprising a low intensity bulb member mounted in a generally tubular member extending from said reflector housing second conical section surface to generate a low intensity light beam at an acute angle to said high intensity light beam;

(h) an energizing sources contained within said cylindrical case member; and (i) first and second switch members each mounted on said case member, said first switch member for selectively energizing said high intensity flash lamp member from said energizing source, and said second switch member for selectively energizing said low intensity bulb member from said energizing source.

37. The multi-beam flashlight device according to claim 36, wherein said low intensity bulb member is movably positioned within said generally tubular member with threaded adjusting means in said generally tubular member for adjusting said low intensity bulb position.

38. The multi-beam flashlight device according to claim 36, wherein said low intensity bulb member is a non-white color.

39. The multi-beam flashlight device according to claim 36, further comprising a mirror assembly reversibly attached to said flat-sided reflector housing encircling member, said mirror assembly comprising;

(i) a planar mirror member having a reflective surface and a non-reflective surface;

(ii) an L-shaped cylindrical bracket member having first and second leg members, said first leg member fastened to said mirror member non-reflective surface, said second leg member extending beyond the mirror reflective surface at a non-perpendicular angle thereto; and (iii) a threaded aperture in said flat-sided reflector housing encircling member adapted for accepting said second leg member threaded end, whereby fastening said mirror assembly to said flat-sided reflector housing encircling member positions said mirror member in the high intensity light beam, thereby reflecting said beam at an angle relative to the beam's original direction.

* * * * *